US008908891B2

(12) United States Patent
Mersky

(10) Patent No.: US 8,908,891 B2
(45) Date of Patent: Dec. 9, 2014

(54) HEARING AID APPARATUS AND METHOD

(75) Inventor: Barry L. Mersky, Highland, MD (US)

(73) Assignee: Audiodontics, LLC, Bethesda, MD (US)

( * ) Notice: Subject to any disclaimer, the term of this patent is extended or adjusted under 35 U.S.C. 154(b) by 443 days.

(21) Appl. No.: 13/043,661

(22) Filed: Mar. 9, 2011

(65) Prior Publication Data

US 2012/0232332 A1 Sep. 13, 2012

(51) Int. Cl.
*H04R 15/00* (2006.01)
*H04R 25/00* (2006.01)

(52) U.S. Cl.
CPC ..... *H04R 25/00* (2013.01)
USPC ..... 381/312; 381/151; 381/380; 381/322; 381/324; 381/311; 381/331

(58) Field of Classification Search
USPC ..... 381/151, 380, 322, 324, 311, 331, 312
See application file for complete search history.

(56) References Cited

U.S. PATENT DOCUMENTS

| | | | | |
|---|---|---|---|---|
| 2,161,169 | A | | 6/1939 | Jefferis, Jr. |
| 2,995,633 | A | | 8/1961 | Puharich et al. |
| 3,594,514 | A | | 7/1971 | Wingrove |
| 4,314,554 | A | | 2/1982 | Greatbatch |
| 4,467,809 | A | | 8/1984 | Brighton |
| 4,473,905 | A | | 9/1984 | Katz et al. |
| 3,156,787 | A | | 11/1984 | Puharich et al. |
| 4,498,461 | A | | 2/1985 | Hakansson |
| 4,606,329 | A | | 8/1986 | Hough |
| 4,612,915 | A | | 9/1986 | Hough et al. |
| 4,665,920 | A | | 5/1987 | Campbell |
| 4,669,980 | A | * | 6/1987 | Degnan ..... 433/8 |
| 4,774,933 | A | | 10/1988 | Hough et al. |
| 4,982,434 | A | | 1/1991 | Lenhardt et al. |
| 5,033,999 | A | | 7/1991 | Mersky |
| 5,074,310 | A | | 12/1991 | Mick |
| 5,190,456 | A | | 3/1993 | Hasegawa |
| 5,318,502 | A | | 6/1994 | Gilman |
| 5,326,349 | A | | 7/1994 | Baraff |
| 5,447,489 | A | | 9/1995 | Issalene et al. |

(Continued)

FOREIGN PATENT DOCUMENTS

WO WO 2007/052251 5/2007

OTHER PUBLICATIONS

Brouns Jr. Experimental wide-band tooth-contact microphone. 1971, *J Audio Engineer*. 9:1:42.

(Continued)

*Primary Examiner* — Quoc D Tran
*Assistant Examiner* — Thomas Maung
(74) *Attorney, Agent, or Firm* — William C. Schrot; Jeffrey I. Auerbach; AuerbachSchrot LLC

(57) ABSTRACT

An apparatus for imparting low amplitude vibrations to at least one tooth in a human head having a cochlea to facilitate hearing via a dental bone conduction pathway includes an extraoral transmitter, a band at least substantially surrounding and adhesively secured to at least one tooth, and a receiver assembly. The transmitter is configured to detect ambient sounds, and to generate and wirelessly transmit audio signals corresponding to the detected ambient sounds. The receiver assembly is removably coupleable to the band and configured to receive the audio signals from the transmitter, and to transduce the audio signals into vibrations that are conducted to the cochlea via the dental bone conduction pathway.

24 Claims, 5 Drawing Sheets

(56) References Cited

U.S. PATENT DOCUMENTS

| | | | | |
|---|---|---|---|---|
| 5,455,842 | A | 10/1995 | Mersky et al. | |
| 5,460,593 | A * | 10/1995 | Mersky et al. | 600/25 |
| 5,706,251 | A | 1/1998 | May | |
| 5,730,151 | A | 3/1998 | Summer | |
| 5,951,292 | A | 9/1999 | Lee | |
| 6,239,705 | B1 * | 5/2001 | Glen | 340/573.1 |
| 6,463,157 | B1 | 10/2002 | May | |
| 6,961,623 | B2 | 11/2005 | Prochazka | |
| 7,043,040 | B2 | 5/2006 | Westerkull | |
| 7,269,266 | B2 | 9/2007 | Anjanappa et al. | |
| 7,486,798 | B2 | 2/2009 | Anjanappa et al. | |
| 7,796,769 | B2 | 9/2010 | Abolfathi | |
| 7,945,068 | B2 | 5/2011 | Abolfathi et al. | |
| 2004/0247143 | A1 | 12/2004 | Lantrua et al. | |
| 2007/0280491 | A1 | 12/2007 | Abolfathi | |
| 2007/0280492 | A1 | 12/2007 | Abolfathi | |
| 2007/0280493 | A1 | 12/2007 | Abolfathi | |
| 2007/0280495 | A1 | 12/2007 | Abolfathi | |
| 2007/0286440 | A1 * | 12/2007 | Abolfathi et al. | 381/312 |
| 2007/0291972 | A1 * | 12/2007 | Abolfathi et al. | 381/326 |
| 2008/0019542 | A1 | 1/2008 | Menzel et al. | |
| 2008/0021327 | A1 | 1/2008 | El-Bialy et al. | |
| 2008/0064993 | A1 | 3/2008 | Abolfathi | |
| 2008/0070181 | A1 | 3/2008 | Abolfathi | |
| 2008/0304677 | A1 | 12/2008 | Abolfathi | |
| 2009/0022351 | A1 | 1/2009 | Wieland et al. | |
| 2009/0048508 | A1 | 2/2009 | Gill et al. | |
| 2009/0052698 | A1 | 2/2009 | Rader et al. | |
| 2009/0088598 | A1 | 4/2009 | Abolfathi | |
| 2009/0097684 | A1 | 4/2009 | Abolfathi et al. | |
| 2009/0097685 | A1 | 4/2009 | Menzel | |
| 2009/0099408 | A1 | 4/2009 | Abolfathi et al. | |
| 2009/0105523 | A1 | 4/2009 | Kassayan et al. | |
| 2009/0147976 | A1 | 6/2009 | Abolfathi | |
| 2009/0149722 | A1 | 6/2009 | Abolfathi et al. | |
| 2009/0270673 | A1 | 10/2009 | Abolfathi et al. | |
| 2009/0274325 | A1 | 11/2009 | Abolfathi | |
| 2009/0281433 | A1 | 11/2009 | Saadat et al. | |
| 2010/0189288 | A1 * | 7/2010 | Menzel et al. | 381/151 |
| 2010/0272299 | A1 | 10/2010 | Van Schuylenbergh et al. | |
| 2011/0007920 | A1 | 1/2011 | Abolfathi et al. | |
| 2011/0015466 | A1 | 1/2011 | Waldmann | |

OTHER PUBLICATIONS

Mersky BL. Technical Report for US Army, SBIR Phase 1, Human Communication Performance in High Noise Environments, Contract DAAD17-00-C-0076, Dec. 22, 2000.

Mersky BL. Technical Report for US Army, SBIR Option Phase 1, Human Communication Performance in High Noise Environments, Contract DAAD17-00-C-0076, May 23, 2003.

* cited by examiner

HEARING AID APPARATUS AND METHOD

FIELD OF THE INVENTION

The present invention relates to an apparatus and a method for imparting low amplitude vibrations to a tooth to facilitate hearing via a dental bone conduction pathway.

BACKGROUND OF THE INVENTION

It is known that imparting acoustic frequency vibrations to the human skull, either directly or via teeth, results in improved hearing in certain hearing impaired individuals. Hearing aids and assistive listening devices taking advantage of this phenomenon generally include a microphone for transducing ambient acoustic energy into an electrical signal, an audio amplifier, a transducer for converting the amplified audio signal to mechanical vibrations, and some mechanism for imparting the vibrations to a tooth or to bone structure in the skull. The imparted vibrations stimulate the cochlea, resulting in a perception of sound. Examples of such devices are disclosed in U.S. Pat. No. 5,460,593 to Mersky et al., and U.S. Pat. No. 5,033,999 to Mersky, the disclosures of which are both incorporated herein by reference.

Some intra-oral hearing aid devices provide for a bracket that is bonded on one surface of a tooth. An in-mouth housing including an actuator and electronic components is configured to engage a side of a tooth that has not been anatomically modified. The bracket may retain the housing, but primarily is intended to pass vibrations from the actuator to the skull. However, such devices suffer from various drawbacks. In particular, if the bracket de-bonds from the tooth, then vibrations are no longer passed from the actuator to the skull, rendering the device inoperable. Moreover, de-bonding of the bracket may result in insufficient retention of the housing, such that the housing falls out of place and/or is rendered inoperable. In addition, such devices provide for the vibrations from the actuator to be conducted through the bracket. The actuator therefore stand-offs or is inefficiently spaced from the tooth, and consequently projects into the cheek (e.g., at least by the thickness or depth of the bracket and bonding material, which is typically at least about 0.080 inch). This stand-off dimension or spacing may result in cheek discomfort and/or externally visible facial puffiness.

Another problem associated with many prior devices relates to the inadequate or ineffectiveness of the vibrator in accurately transducing the applied electrical signals into mechanical vibrations. Another problem associated with prior devices relates to the ineffective or inefficient manner in which the transducer is coupled to the hard bone tissue. In particular, many prior art tooth coupling techniques suffer from various disadvantages, including; low coupling efficiency (e.g., resulting in a significant loss of mechanical energy); deterioration of coupling efficiency over time; difficulty of removing or replacing the vibrating member; or a combination of these disadvantages. For example, in human experiments where the actuator was part of a C-ring that went behind the last maxillary molar, the inventor found that over time, the "spring force of the C-ring" became unsatisfactorily weak, and thus the coupling efficiency was reduced.

Further, many prior devices provide vibrating members that rely on an osseointegration member to secure the devices to bone tissue and to act as the skull stimulation site. Such devices involve a major surgical procedure, and have longer-term problems associated with the surgical implant.

Other prior art devices secure the actuator to the skull by magnetic force associated with an osseointegrated implant.

Such deliver electromagnetic signals transcutaneously to the implanted member which then vibrates. This transcutaneous, as opposed to direct, coupling of the signal to the implant can result in a considerable loss of energy particularly when the scalp tissue swells. This energy loss increases with the square of the distance between the external unit and implant. Moreover, the magnetic attraction between the external unit and vibrator will deteriorate over time resulting in further loss of efficiency. Finally as a practical manner, should the implanted member need removal, a permanent hole will remain in the skull bone.

Most present systems that impart vibrations to bone tissue rely on magnetic or piezoelectric transducers. Magnetic transducers involve reciprocating translation of a magnetically permeable disk and armature member. These devices tend to be inefficient in transducing electrical energy into reciprocating translatory motion, and are operable only over limited frequency ranges due to inertial constraints of the movable member. Piezo-ceramic devices also tend to be inefficient, given they require relatively high voltages and are notoriously ineffective at frequency ranges below 1 KHz.

SUMMARY OF THE INVENTION

The present invention is directed to an improved method and apparatus for efficiently imparting controllable, reproducible small amplitude vibrations to a tooth or teeth for improving hearing via the dental bone conduction pathway. The present invention also relates to an improved method and apparatus for attaching to a tooth a vibrating device that effectively transduces electrical energy to mechanical energy at or near the coupling site. The present invention also relates to a method of modifying a tooth for receiving an apparatus that contains a vibrating device to more effectively transduce electrical energy to mechanical energy at or near the tooth coupling site. The present invention also relates to a method and apparatus for efficiently coupling an electromechanical transducer to teeth in a manner permitting the transducer to be readily removed and/or replaced.

The de-bonding problems associated with some prior systems may be overcome via anatomical modification of one or several different surfaces of a tooth. The tooth may be modified when it is prepared to receive a metal orthodontic-like band, which completely or substantially surrounds the tooth. Exemplary tooth preparations may be via an acid-etching process, a physical shaving of the tooth, and/or a roughing of the tooth surface.

The retention of the orthodontic-like band is greatly enhanced after anatomical modification of several surfaces of a tooth. Prior systems which avoid such anatomical modification to any or multiple surfaces of the tooth and are retained by a dental bracket covering a limited tooth surface area, fail to achieve assured retention of the in-mouth device. According to the present invention, the use of a metal band that covers multiple tooth surfaces, and which may be cemented to the tooth after anatomical modification of the tooth (e.g., such as by acid-etching or dental drilling), provides superior retention of the in-mouth device.

According to one embodiment, the disclosed device includes a transducer for imparting low amplitude vibrations to create corresponding low levels of strain in a tooth or teeth. The transducer utilizes a highly magnetostrictive member. A cyclical magnetic field is applied to the magnetostrictive member, which causes the magnetostrictive member to cyclically increase and decrease in length. Highly magnetostrictive alloys, such as Terfenol-D, provide efficient conversion of electrical energy to mechanical energy over a wide range of frequencies extending from below 1 Hz to a high supersonic range. The resulting cyclical dimensional changes in the magnetostrictive member (as contrasted with translation or movement of the member) create a cyclical force in a push-pull fashion that is efficiently imparted to a tooth or teeth via an actuator element. The resulting forces may be utilized to effect conduction via the dental bone conduction pathway of acoustic waves for the enhancement of hearing.

In one embodiment, the vibrations from the actuator element are transmitted to a tooth or teeth through a metal band that surrounds the tooth. In another embodiment, a portion of the actuator element is in direct contact with the tooth, so that the vibrations are transmitted directly to the tooth. The actuator element is held in proper position against or relative to the tooth through the use of a precision connector on a metal band. The band may be secured to either the tooth through which the vibrations are transmitted, or to a nearby or adjacent tooth. The band may be secured to the tooth via dental cement. In one implementation, the precision connector is a female connector to which a correspondingly configured male connector on the receiver assembly is releasably attachable. The receiver assembly includes the actuator (e.g., including the magnetostrictive member). Thus, the receiving assembly is removably securable to the band and thus contact with the tooth is assured.

The present invention also relates to an apparatus for imparting low amplitude vibrations to at least one tooth in a human head having a cochlea to facilitate hearing via a dental bone conduction pathway. The apparatus includes an extraoral transmitter configured to detect ambient sounds, and to generate and wirelessly transmit audio signals corresponding to the detected ambient sounds. A band at least substantially surrounds at least one tooth. The band is affixed to the at least one tooth by an adhesive. A receiver assembly is removably coupleable to the band and configured to receive the audio signals from the transmitter, and to transduce the audio signals into vibrations that are conducted to the cochlea via the dental bone conduction pathway.

In one embodiment, the receiver assembly includes a transducer having an actuator element configured to transduce the audio signals. In one implementation, the actuator element contacts a portion of the band so that the vibrations are conducted through the band to the tooth. In one implementation, the transducer is an electromechanical transducer. In one implementation, the actuator element directly contacts an outer surface of the tooth so that the vibrations are conducted directly to the tooth. In one implementation, the band includes an opening, and a distal end of the actuator element extends through the opening and engages the outer surface of the tooth. In one implementation, the receiver assembly is coupled to the band, and the actuator element is disposed at an angle of between about 0° and about 90° relative to a longitudinal axis of the at least one tooth.

In one embodiment, the band at least substantially surrounds a first tooth. The receiver assembly transduces the audio signals into vibrations that are conducted through a second tooth. In one implementation, the band is a first band, and the apparatus further includes a second band at least substantially surrounding a third tooth, the third tooth being in between the first tooth and the second tooth.

In one embodiment, the receiver assembly includes a transducer. The transducer includes a magnetostrictive member responsive to a varying magnetic field passing therethrough for expanding and contracting in size in response to variations in the magnetic field. An electrical coil is provided, which is responsive to variable electrical voltage and current passing therethrough for creating a varying electromagnetic field that passes through the magnetostrictive member, thereby causing the magnetostrictive member to expand and contract in size in response to variations in the magnetic field. The transducer also includes a permanent magnet, which effects the electromagnetic field produced by the electrical coil. An actuator element is in contact with the magnetostrictive member. The actuator element vibrates as the magnetostrictive member expands and contracts in size.

In one embodiment, the transducer further includes at least one resilient element capable of compressing the magnetostrictive member, thereby generating stress within the magnetostrictive member. In another embodiment, the actuator element is capable of compressing the magnetostrictive member, thereby generating stress within the magnetostrictive member.

In one embodiment, the band includes at least a first connector, and the receiver assembly includes at least a second connector. The first connector is releasably securable to the second connector so that the receiver assembly is removably secured to the band in a fixed orientation. In one implementation, the first connector includes a receiver channel configured to receive and releasably retain the second connector therein. In a related implementation, the first connector is nearly circular in design, allowing for a snap-like fitting between the first connector and second connector. In one implementation, the first connector is formed from a material selected from the group consisting of a biocompatible metal or a biocompatible plastic. In one implementation, the first connector includes a spring lock whose physical properties are activated upon contact with the second connector. The spring lock may be formed from a material comprising nickel titanium.

In one embodiment, the adhesive anatomically modifies an the enamel of the tooth. The modified enamel is utilized to enhance adherence of the band to the tooth. In one implementation, the adhesive comprises a cement selected from the group consisting of zinc phosphate, zinc silico-phosphate, zinc polyacrylate, zinc-polycarboxylate, glass ionomer, resin-based, and silicate-based cement.

In one embodiment, the transducer applies a first force against one of the band or the tooth. The receiver assembly further includes a means for applying a second force to one of the band or the tooth. The second force opposes the first force so that a vector sum of the first and second forces is substantially equal to zero.

The present invention also relates to a method for imparting low amplitude vibrations to at least one tooth in a human head having a cochlea to facilitate hearing via a dental bone conduction pathway. The method includes the steps of: a) securing an extraoral transmitter unit to a user, the transmitter unit configured to detect ambient sounds, and to generate and wirelessly transmit audio signals corresponding to the detected ambient sounds; b) providing a receiver assembly configured to receive the audio signals from the transmitter unit, and to transduce the audio signals into vibrations; c) adhesively securing a band around at least one tooth in a mouth of the user; and d) releasably securing the receiver assembly to the band so that the transduced vibrations are conducted to the cochlea via the dental bone conduction pathway.

In one embodiment, the method includes the further step of anatomically modifying the at least one tooth prior to said step of adhesively securing the band.

In one embodiment, the method includes the further step of providing a receiver assembly comprising a transducer having an actuator element. The actuator element is maintained against an outer surface of the at least one tooth during said step of releasably securing the receiver assembly.

In one embodiment, the method includes the further steps of: forming a dental impression of the at least one tooth, secured band and structure in the mouth surrounding the at least one tooth; fabricating a dental cast based on the formed dental impression; and fabricating the receiver assembly on the dental case prior to said step of releasably securing the receiver assembly to the band.

BRIEF DESCRIPTION OF THE DRAWINGS

Like reference numerals have been used to identify like elements throughout this disclosure.

DETAILED DESCRIPTION OF THE INVENTION

The "dental bone conduction pathway" may be considered a sub-pathway of the widely recognized non-acoustic "bone conduction pathway" for sound transmission to the hearing nerve. As used in this invention, the phrase "dental bone conduction pathway," relates to non-acoustic sound (vibration) that originates in structures of the mouth, nose, and oro-pharynx and is ultimately perceived at the hearing nerve. Speech sounds and chewing sounds, for example, travel to the hearing nerve via the "dental bone conduction pathway." By contrast, loud ambient helicopter-like noise that penetrates the skin over the entire skull, neck, and body and can be considered noise arriving at the hearing nerve via the bone conduction pathway. Similarly, standard bone conduction audiometry with skull stimulation at the mastoid or forehead uses the general "bone conduction pathway," as compared to the specific dental bone conduction pathway.

The distinction between conduction pathways is relevant due to the anatomical differences between the pathways. The bio-mechanical forces in the dental bone conduction pathway are variable, and thus may create variable results when compared to stimulation of structures elsewhere on the skull (e.g., such as at the mastoid or forehead). The large resonant chamber, anatomically defined by the mouth and oropharynx, has its resonance frequency altered by opening and closing the mouth, and by movements of the tongue, lips, and vocal chords (e.g., such as during human speech). Other pathway entrances on the skull do not contain such compliant muscles and ligaments (except in the middle ear, although whether the middle ear may be considered "an entrance point" to the bone conduction pathway is an academic question). Further, other skull areas have far less voluntary muscle and compliant soft tissue compared to the tongue and cheeks of the mouth. Moreover, such other skull areas include more fixed chambers (e.g., frontal sinuses, mastoid air cells, external ear canal), and thus necessarily have more consistent volumes, mechanical loads, and input mechanical point impedances than do structures of the mouth and pharynx (and thus the structures comprising the dental bone conduction pathway).

Figure 1:
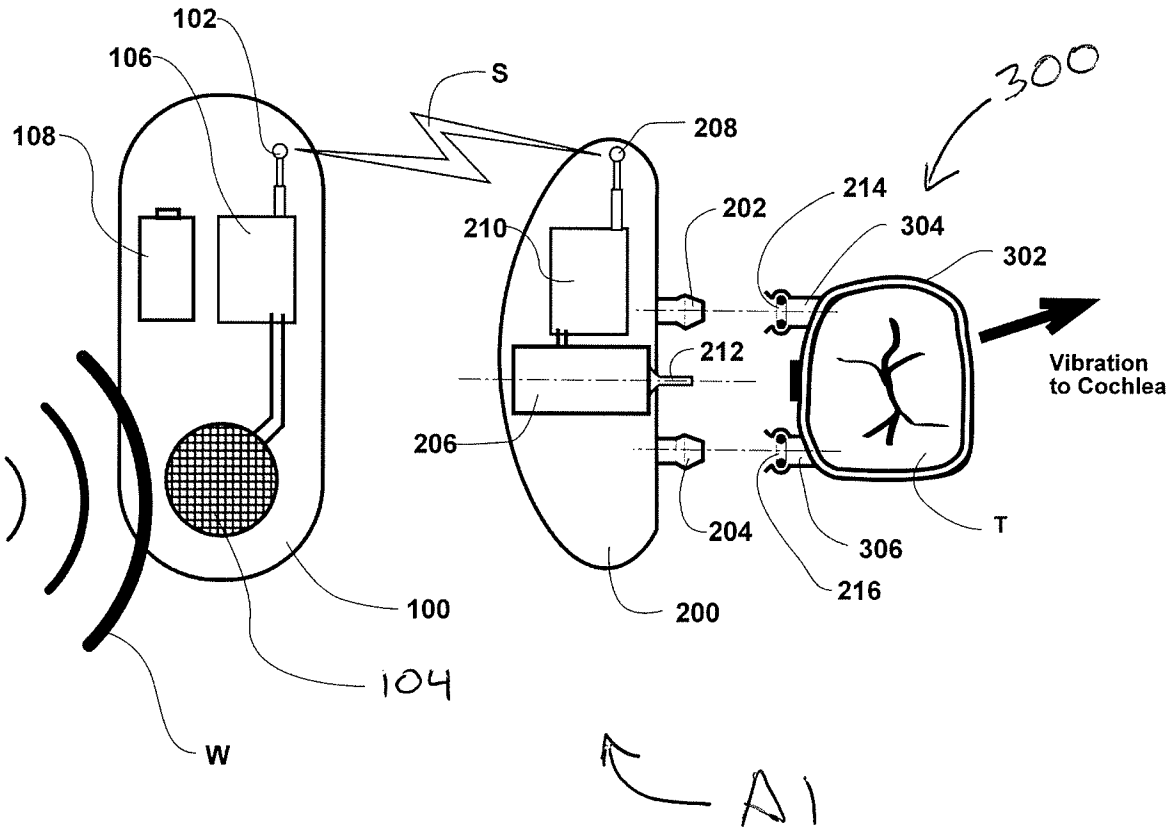
FIG. 1 illustrates a schematic diagram of a hearing aid apparatus according to an embodiment of the present invention.

FIG. 1 illustrates a schematic diagram of a hearing aid apparatus A1 according to an embodiment of the present invention. The apparatus A1 includes an extraoral transmitter unit 100 configured to detect sound waves W, such as waves composed of frequencies within the range of human hearing and of a level sufficiently strong to be heard. In one implementation, the transmitter unit 100 is configured to be worn in or around an ear of a user, similar to a hearing aid, such as a behind-the-ear contralateral routing of signals (CROS) hearing aid.

The transmitter unit 100 is configured to process the detected sound W into audio signals S, and wirelessly transmit the audio signals S to a receiver assembly 200 disposed within the mouth of the user. The receiver assembly 200 is releasably coupled to a tooth or teeth via an attachment mechanism 300. Further, the receiver assembly 200 is configured to electrically insulate and safely seal (such as from fluids, food, or other particles within the mouth) electrical and other components therein.

In one embodiment, the attachment mechanism 300 includes a band 302 entirely or substantially surrounding a tooth T. The band 302 may be formed from metal or some other material suitable for attaching to the tooth T. In one implementation, the band 302 is secured to the tooth T or to a prosthetic dental crown via a cement. Exemplary cements suitable for securing the band 302 to the tooth T include cements used in orthodontic practice such as zinc phosphate, zinc silico-phosphate, zinc polyacrylate, zinc-polycarboxylate, glass ionomer, resin-based, and silicate-based cements. The band 302 is cemented or secured to the tooth T following tooth preparation by a dentist. For example, such preparation may include shaving of the proximal surfaces so that the band 302 can be secured to the tooth without the orthodontic procedure of tooth separation. (In such a procedure, spacers are placed for several days as a means of creating open contacts between teeth, so that a band may then be inserted around the tooth). Alternatively, anatomical modification of the tooth in preparation for bonding may include acid etching or microsandblasting of the tooth T. Dental polymers may also be utilized to enhance bonding. Further, multiple tooth surfaces may be prepared, as described in further detail below.

In one implementation, the band 302 includes first and second connectors 304, 306. Preferably, the connectors 304, 306 are permanently affixed to the band 302, or defined by portions of the band 302. The connectors 304, 306 of the band 302 are configured to be releasably coupled to correspondingly configured connectors 202, 204 provided on the receiver assembly 200. In particular, connector 202 of the receiver assembly 200 is releasably connectable to connector 304 of the band 302, and connector 204 of the receiver assembly 200 is releasably connectable to the connector 306 of the band 302. For example, the coupling between connector 202 and connector 304, and the coupling between connector 204 and connector 306, may be a male-female type precision connection that securely connects the receiver assembly 200 to the band 302 (and thus to the tooth T).

In one embodiment, the connectors 304, 306 may be biased outwardly by enlarged distal ends or flanges provided on the connectors 202, 204 when coupling the connectors 202, 204 to the connectors 304, 306. The connectors 304, 306 are formed from a resilient material, which springs back to an initial position once the enlarged distal ends of the connectors 202, 204 are pushed inwardly into corresponding receiving areas, thereby releasably locking the connectors 202, 204 to the connectors 304, 306.

In one embodiment, the band 302 is attached to a maxillary or top molar tooth T and the receiver assembly 200 is worn in the buccal vestibule (the area between the inside of the cheek and the teeth and gums). When the apparatus A1 is operating, the transmitter unit 100 detects ambient sounds W. The detected sounds W are processed into audio signals S, and then wirelessly transmitted as signals S to the receiver assembly 200. The signals S are received by the receiver assembly 200. The signals S are then transduced into vibrations by an associated transducer 206 within or coupled to the receiver assembly 200. The vibrations are directed into or against the tooth T by the transducer 206. In turn, the vibrations are conducted from the tooth T to the hearing nerve or cochlea, so that the user hears the ambient sounds via the dental bone conduction pathway.

An exemplary transducer suitable for use with the present invention is disclosed and illustrated in FIG. 1 of U.S. Pat. No. 5,460,593 to Mersky et al. For example, the transducer 206 may include a magnetostrictive member responsive to a varying magnetic field passing therethrough. The magnetostrictive member expands and contracts in size in response to variations in the magnetic field. An electrical coil responsive to variable electrical voltage and current passing therethrough creates a varying electromagnetic field. The varying electromagnetic field passes through the magnetostrictive member, thereby causing the magnetostrictive member to expand and contract in size in response to variations in the magnetic field. The transducer 206 also includes a permanent magnet, which affects the electromagnetic field produced by the electrical coil. An actuator element is in contact with the magnetostrictive member, and vibrates as the magnetostrictive member expands and contracts in size. The transducer 206 may also include one or more resilient elements capable of compressing the magnetostrictive member, thereby generating stress within the magnetostrictive member.

The transmitter unit 100 includes an antenna 102 or inductive loop, which is tuned to a receiver antenna 208 or inductive loop of the receiver assembly 200. Additional components for such wireless transmission may also be provided. For example, the transmitter unit 100 may include a microphone 104, control circuitry 106, a power supply 108, and/or other components typical to a hearing aid transmitter unit used in a CROS hearing aid device.

The receiver assembly 200 is worn inside the mouth, preferably in the buccal vestibule. The receiver assembly 200 includes control circuitry 210 configured to process and transduce signals S received from the transmitter unit 100 via the transducer 206. The transducer 206 includes an actuator element 212, which includes a distal end portion configured to engage the band 302, or to directly engage and make physical contact with an exterior surface of the tooth T (discussed in further detail below). The tooth surface may be either natural dental enamel, or alternatively tooth restoration material (e.g., such as installed by a dentist). For example, the restoration material may be dental amalgam or composite or a prosthetic restoration such as a crown composed of a typical dental material (e.g., gold, porcelain, etc.).

The receiver assembly 200 also includes connectors 202, 204 for mechanically securing the receiver assembly 200 to the band 302, as described above. The precision connection between the connectors 202, 204 of the receiver assembly 200 and the corresponding connectors 304, 306 of the band 302 ensure that the actuator element 212 of the transducer 206 is properly aligned with and engaging the metal band 302 or the surface of the tooth T.

In order to achieve maximal efficiency of the transducer 206, it is desirable to couple the receiver assembly 200 to the band 302 so that a proper coupling angle is achieved between the actuator element 212 and the band 302 or the surface of the tooth T. Further, the receiver assembly 200 should be securely coupled to the band 302 so that the orientation of the receiver assembly 200 relative to the tooth T remains substantially constant and rigid. At the same time, the orientation of the receiver assembly 200 should be relatively comfortable for the user. Thus, the receiver assembly 200 should fit comfortably within the buccal vestibule, while also being sufficiently spaced from the occlusal plane so that the receiver assembly 200 does not move during eating, grinding or other movement of the mouth, teeth and jaw.

According to one embodiment, mouth molds are taken by a dentist that reflect both the spatial orientation of the connectors 304, 306 on the band 302, as well as the surrounding gingival and vestibule areas. Based on the mouth molds, a precise and selected orientation of the receiver assembly 200, and corresponding angulation of the transducer 206 relative to the band 302 and/or surface of the tooth T, may be achieved.

Figure 2:
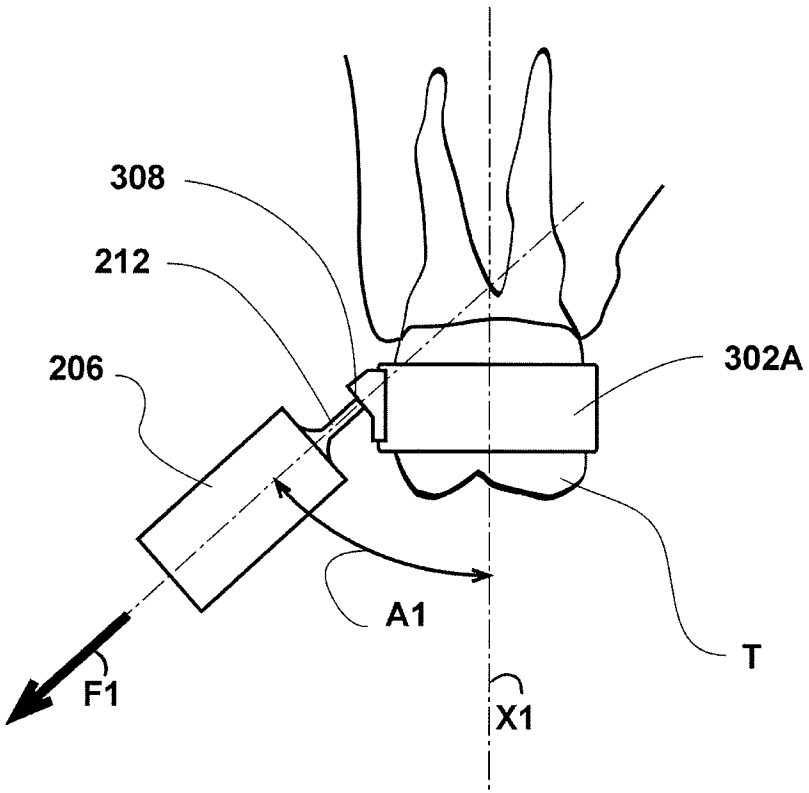
FIG. 2 illustrates a mesial view of an upper right molar tooth, and showing a band surrounding and affixed to the molar tooth and a transducer removably coupled to the band.

Referring to FIG. 2, an exemplary angulation of the actuator element 212 of the transducer 206 relative to a band 302A (or tooth T if an opening or slit is provided in the band 302A) is illustrated. In one implementation, a contact angle A1 between the actuator element 212 and a longitudinal axis X1 of the tooth T (or central axis of the band 302A) is approximately 45°. The contact angle A1 ensures an efficient transfer of vibrations from the transducer 206 to the tooth T (either directly or through the band 302A), and thus from the tooth T to the cochlea.

In one embodiment, the proper contact angle A1 is achieved via a bump-out or projection 308 coupled to or defined by the band 302A. The projection 308 is relatively easy to form, particular in metal band 302A. Further, the projection 308 has a relatively low profile, and is therefore comfortable to the cheek of the user when the receiver assembly 200 has been removed (such as at night).

With continued reference to FIG. 2, the projection 308 of the band 302A (and associated connectors, such as connectors 304, 306) is configured so that the transducer 206 of the receiver assembly 200 points in an upward gingival direction (extending from the occlusal to the gingival direction) when coupled to the band 302A. When seating the receiver assembly 200 on the band 302A (or 302), the connectors 202, 204 are aligned with and engage the corresponding connectors 304, 306 on the band 302A, as described above. When the connectors 202, 304 and 204, 306 are fully engaged or releasably locked together, the actuator element 212 is positioned against the band 302A or the tooth T at the proper contact angle A1.

In one implementation, the actuator element 212 projects slightly beyond the plane of the connectors 202, 204. The actuator element 212 engages the band 302A at the projection 308 (and/or the tooth T through a correspondingly configured opening or slit in the projection 308) when the receiver assembly 200 is fully and properly seated on the band 302A. Because of the relatively tight fit between the connectors 202, 304 and 204, 306, and given the greater length of the actuator element 212 relative to the connectors 202, 204, the actuator element 212 is pressed into the band 302A and/or against the outer surface of the tooth T. As a result, an outwardly directed force F1 is created, which is exerted into or on the transducer 206 by the actuator element 212.

The actuator element 212 is slightly compressed and/or tensionably biased away from its static position when the receiver assembly 200 is properly seated on the band 302A. This force F1 created between the transducer 206 (and receiver assembly 200) and the band 302A and/or tooth T may be controlled by adjusting the configurations and coupling force of the connectors 202, 204 and/or connectors 304, 306. Alternatively or in addition, and presuming the coupling force of connectors 202, 204, and 304, 306 are unchanged, then this force F1 may be controlled by adjusting the length and/or spring action of the actuator element 212.

Figure 3:
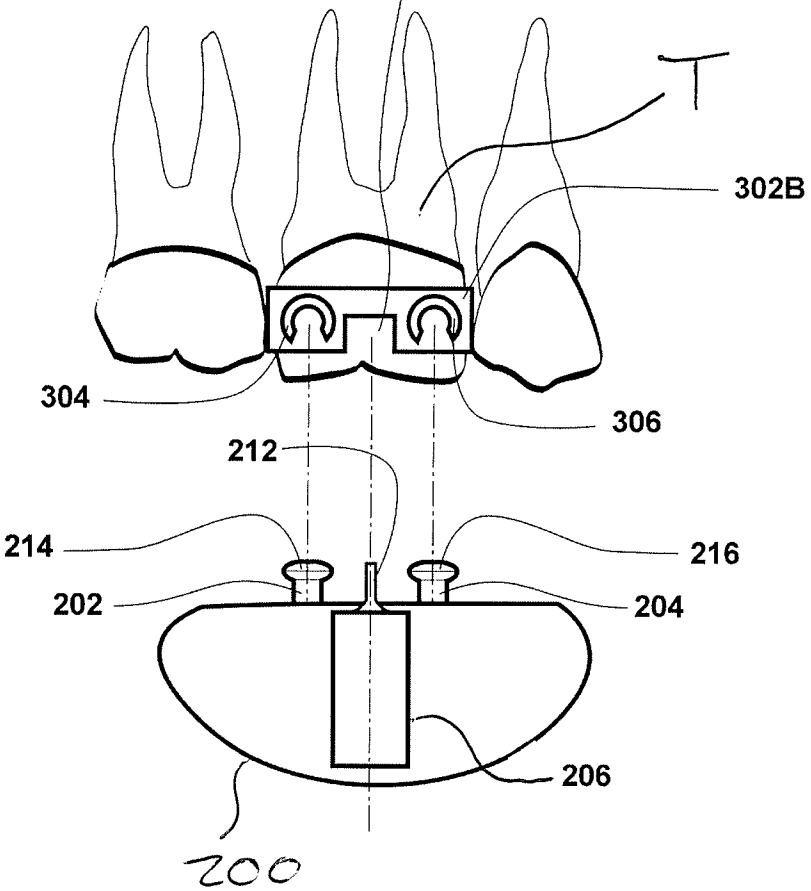
FIG. 3 illustrates a buccal view of three teeth, and showing a molar tooth including a band having female attachment members for receiving connectors of the transducer and a slit for receiving an actuator element of the transducer.

Alternatively or in addition, this force F1 may be controlled by providing compressible elements 214, 216 intermediate to the mating connectors 202, 304 and 204, 306, as shown in FIGS. 1 and 3. In one implementation, compressible elements 214, 216 are coupled to the distal ends of the connectors 202, 204 (as shown in FIG. 3). In another embodiment, compressible elements 214, 216 are coupled to connectors 304, 306 (e.g., such as in recesses configured to receive the compressible elements 214, 216 and the distal ends of the connectors 202, 204 (as shown in FIG. 1). Accordingly, the force F1 may be controlled by adjusting the configuration of the compressible elements 214, 216.

The compressible elements 214, 216 may be formed of various plastic materials, composites or other suitable materials having compressibly resilient characteristics. For example, in one implementation, each compressible element 214, 216 includes a slit tube of spring metal such as nickel titanium, which is connected to a corresponding one of the connectors 202, 204. The resulting assemblies of the coupled connectors 202, 204 and compressible elements 214, 216 are then mated and secured via an interference fit within a correspondingly configured cavity or surface of the connectors 304, 306 of the band 302 (or 302A). In an alternative embodiment, the compressible elements 214, 216 may be formed from a spring wire, which is bent or configured to create a friction fit within the corresponding connectors 304, 306 of the band 302 (or 302A).

Other means may be employed to control or adjust the spring force F1 between the band 302 (or 302A) or tooth T and the transducer 206 (and receiver assembly 200). For example, alternative spring designs of the connectors 202, 204 and/or connectors 304, 306 may be provided. Alternatively or in addition, the connectors 202, 204 and/or 304, 306 may be partially or entirely covered with a resilient and deformable plastic material (thus functioning in a manner similar to the compressible elements 214, 216). Further, the length and material composition of the connectors 202, 204, 304, 306 and/or the actuator element 212 may also affect the force F1 between the band 302 (or 302A) and/or tooth T and the transducer 206. In one implementation, the actuator element 212 is formed from a flexible spring wire, such as nickel titanium, which tensionably engages the band 302 (or 302A) and/or the tooth T.

Thus, the connectors 202, 204 and optionally the compressible elements 214, 216, are configured so that when mated with the corresponding connectors 304, 306, the vibrating end of the actuator element 212 is urged to contact the band 302 (or 302A), or contact the surface of the tooth T. The static force F1 exerted by the transducer 206 (and receiver assembly 200) on the band 302 (or 302A) and/or tooth T (and thus on the periodontal ligaments surrounding and supporting the tooth T) is controlled by the configuration of the connectors 202, 204 and connectors 304, 306 (and optionally or additionally by the configuration of the compressible elements 214, 216), as well as on configuration and material characteristics of the actuator element 212. The static force F1 is thus repeatable and determinable based on the configuration and materials used for the elements 212, and connectors 202, 204, 304, 306, and compressible elements 214 and 216. [It should be understood that the nominal static force F1 is actually a potential orthodontic or "tooth moving" force. Also, force F1 becomes a "dynamic force" when transducer 206 is operating, that is, vibrating.]

With continued reference to FIG. 3, a band 302B according to another embodiment is illustrated. Similar to the band 302A, the band 302B includes connectors 304, 306 matingly coupleable to the corresponding connectors 202, 204 of the receiver assembly 200. In addition, the band 302B includes an opening or slit 310 through which the distal end of the actuator element 212 of the transducer 206 extends. Thus, the actuator element 212 does not directly contact the metal band 302B, but instead directly contacts and tensionably engages the surface of the underlying tooth T (or the surface of the dental restoration).

The seating of the receiver assembly 200 on the band 302B may be similar to the seating of band 302A as described above. Accordingly, the transducer 206 of the receiver assembly 200 extends in an upward direction (extending from the occlusal to the gingival) when coupled to the band 302B.

The underlying tooth T is prepared by a dentist or other technician so that the band 302B is secured to the tooth T to provide the proper contact angle A1 between the actuator element 212 of the transducer 206 and band 302B. Note that the band 302B may include a bump-out or projection 308 (such as shown in FIG. 2) for achieving the proper contact angle A1 and for seating the receiver assembly 200, as described above. For example, in one implementation, a contact angle of about 45° aids the seating the receiver assembly 200 due in part to the elimination of undercuts. Further, the potential orthodontic force F1 created between the transducer 206 and the tooth T (as well as the connectors 202, 304 and 204, 306) may be controlled as described above. Such control should render the potential orthodontic force to sub-clinical, benign level.

If the tooth T is unfavorably inclined or band 302B is unfavorably tilted for easy insertion/removal of unit 200, this spatial orientation problem will be apparent to the technician on the bench-top prior to fabrication of the receiver assembly 200. Any such problem may be corrected by the technician through adjustment of the configuration of the receiver assembly 200 and/or the orientation and configuration of the transducer 206 and/or actuator element 212 relative to the overall configuration of the receiver assembly 200. For example, the length of the actuator element 212 may be adjusted and/or the use of appropriately configured compressible elements 214, 216 (or coatings) may be employed.

Figure 4A:
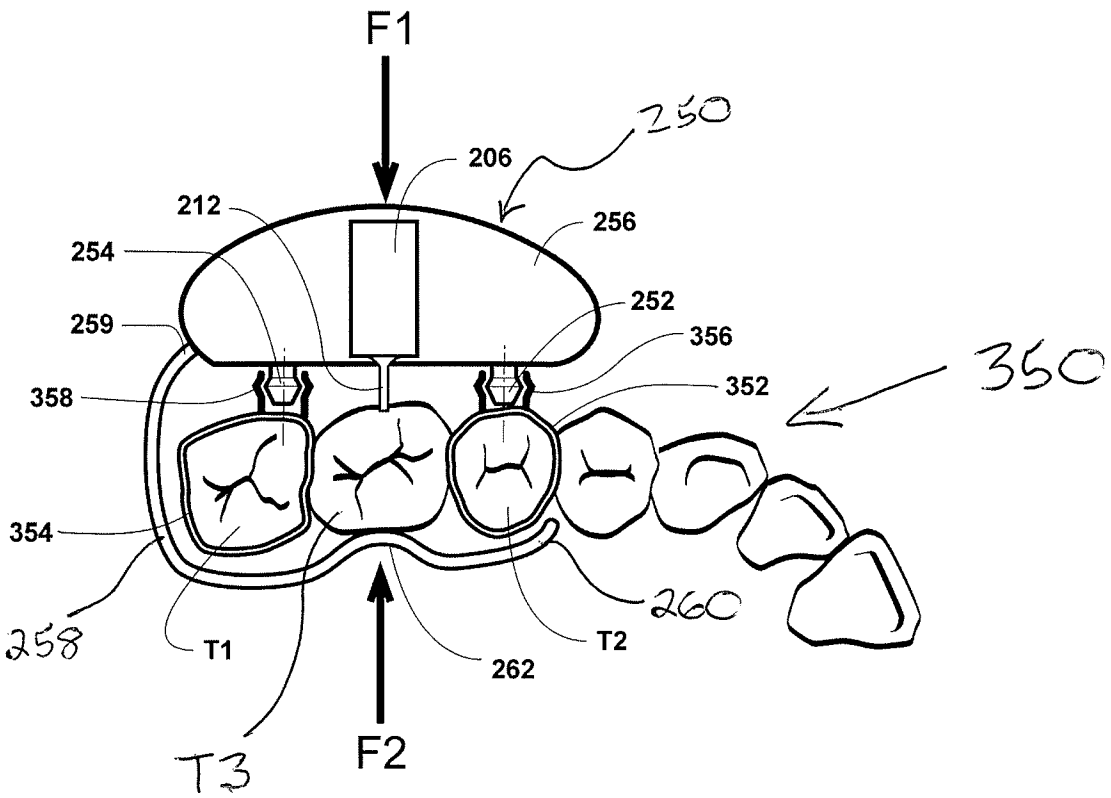
FIG. 4A illustrates a perspective occlusal view of three teeth, and showing an apparatus for coupling a transducer to the teeth according to another embodiment.
Figure 4B:
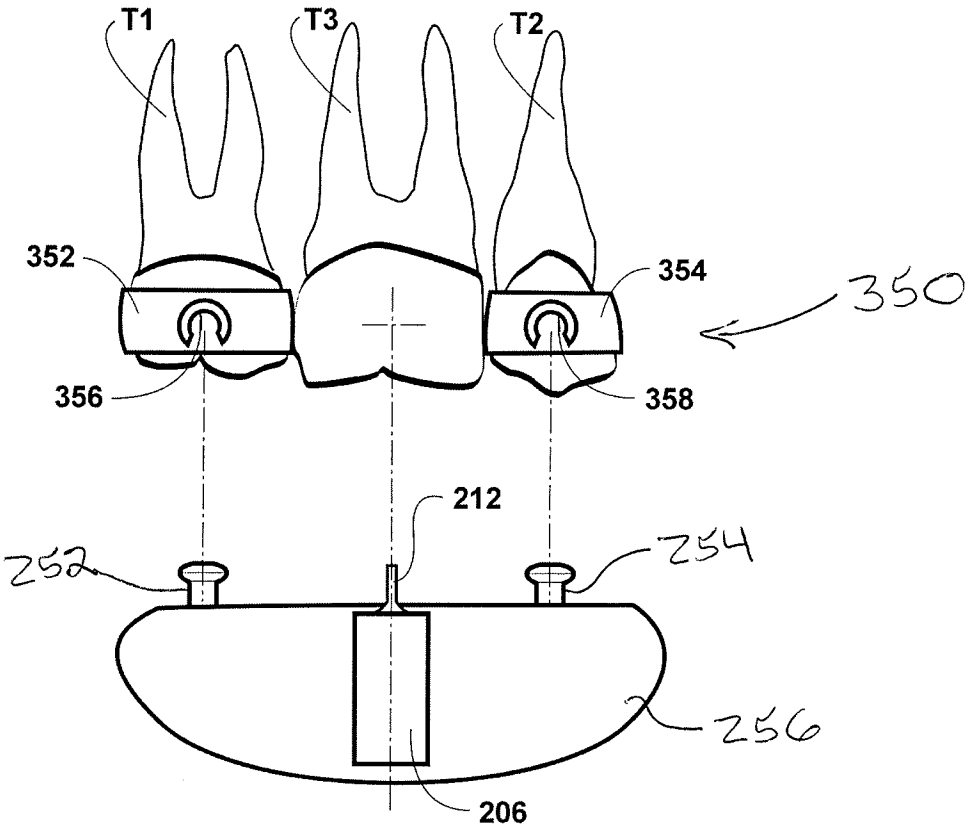
FIG. 4B illustrates a buccal view of the teeth of FIG. 4A with some elements of the receiving assembly cut away.

An attachment mechanism 350 for coupling a receiver assembly 250 within the mouth according to another embodiment is illustrated in FIGS. 4A and 4B. The attachment mechanism 350 includes a first band 352 configured to entirely or substantially surround a first tooth T1, and a second band 354 configured to entirely or substantially surround a second tooth T2. The bands 352, 354 may be formed from metal or some other material suitable for attaching to the teeth T1, T2, as described above. Further, the teeth T1, T2 are anatomically modified and prepared prior to attachment of the bands 352, 354, such as by the methods described above.

The first band 352 includes a connector 356 coupleable to a correspondingly configured connector 252 extending from the receiver assembly 250. Similarly, the second band 354 includes a connector 358 coupleable to another correspondingly configured connector 254 extending from the receiver assembly 250.

The receiver assembly 250 includes a transducer, such as transducer 206 positioned in between the connector 252 and the connector 254. The connectors 252, 254 are sufficiently spaced so that, when the receiver assembly 250 is coupled to the bands 352, 354, the actuator element 212 of the transducer 206 is aligned with and engaging a tooth T3 that is in between tooth T1 and tooth T2. Thus, the actuator element 212 directly contacts an outer surface of the tooth T3.

In one embodiment, the receiver assembly 250 includes a body 256 which houses the transducer 206, as well as other components such as the receiver antenna 208 and control circuitry 210 (such as shown in FIG. 1). A wire or other retaining member 258 includes a first end 259 coupled to the body 256 and an opposite distal end 260. The retaining member 258 is configured to extend from the body 256 and around at least tooth T2 and tooth T3. In one implementation, the retaining member 258 also extends partially around or proximate to the other tooth T1. Thus, the retaining member 258 extends from the body 256 of the receiver assembly 250, and extends against and/or past one tooth T2 (e.g., behind the most posterior maxillary tooth), past or against the surface of tooth T3, and past or against at least a portion of the other tooth T1.

In one embodiment, a central portion 262 of the retaining member 258 traverses the lingual surfaces, and directly engages the 'middle' or un-banded tooth T3. The retaining member 258 is tensionably resilient so that a force F2 inwardly directed against the un-banded tooth T3 is generated when the receiver assembly 250 is coupled to the bands 352, 354. The force F2 opposes and is preferably reciprocal to the potentially orthodontic force F1 generated from element 212 of the transducer 206 against the tooth T3. Thus, the force F1 against one side of the tooth T3 is balanced to a sub-clinical level by an opposing force F2 against the opposite side of the tooth T3. This balancing of opposing forces (F1-F2) is similar to that typically achieved in a prosthodontic removable partial denture (RPD), with the "retentive forces" of a typical clasp being balanced by the "reciprocal forces" of the RPD. As a result, the actuator element 212 is securely positioned against the tooth, without unduly and adversely pressing into the tooth T3 and potentially causing clinically significant orthodontic stress on the periodontal ligaments of T3. In addition, the opposing forces F1, F2 aid is retaining the receiver assembly 250 in its properly seated position against the teeth T1, T2, T3.

Further, when inserting the receiver assembly 250 into the mouth, the retaining member 258 aids in guiding the receiver assembly 250 into its proper orientation against the teeth T1, T2, T3. Once the proper position is located, the receiver assembly 250 may then be relatively easily clipped into place by the user.

Because the force F1 created by the transducer 206 need not be opposed by the coupling members securing the receiver assembly 250 to the bands 352, 354 (such as the connectors and compressible members as described above), the receiver assembly 250 is relatively easy for a user to install in his or her mouth. Moreover, the receiver assembly 250 has a lower profile compared to other arrangements, and therefore may be more comfortable for some users. A lower profile of the receiver assembly 250 is achieved because the actuator element 212 of the transducer 206 directly contacts the tooth T3 (as opposed to a band or other component). As such, the transducer 206 is not standing-off from and into the user's cheek the additional distance required for the band and cement. For example, the band and cement may have a combined thickness of about 0.060 inch (1.52 mm). Thus, those embodiments of receiver assemblies including an actuator element 212 that directly contacts a tooth (e.g., such as shown in FIGS. 3 and 4) may have a slimmer appearance and feel against the cheek of the user.

It is to be understood that terms such as "left," "right," "top," "bottom," "front," "end," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Although the disclosed inventions are illustrated and described herein as embodied in one or more specific examples, it is nevertheless not intended to be limited to the details shown, since various modifications and structural changes may be made therein without departing from the scope of the inventions. In addition, various features from one of the embodiments may be incorporated into another of the embodiments. Accordingly, it is appropriate that the invention be construed broadly and in a manner consistent with the scope of the disclosure and as set forth in the following claims.

What is claimed is:

1. An apparatus for imparting low amplitude vibrations to at least one tooth in a human head having a cochlea to facilitate hearing via a dental bone conduction pathway, the apparatus comprising:

an extraoral transmitter configured to detect ambient sounds, and to generate and wirelessly transmit audio signals corresponding to the detected ambient sounds;

a band at least substantially surrounding at least one tooth, the band affixed to the at least one tooth by an adhesive, the band including at least a first connector; and a receiver assembly removably coupleable to the band and configured to receive the audio signals from the transmitter, the receiver assembly including a transducer having an actuator element and configured to transduce the audio signals into vibrations that are conducted to the cochlea via the dental bone conduction pathway, the transducer comprising a magnetostrictive member responsive to a varying magnetic field passing therethrough which elongates and contracts in response to variations in the magnetic field, and the actuator element in contact with the magnetostrictive member which vibrates as the magnetostrictive member elongates and contracts, and the receiver assembly including at least a second connector spaced from the actuator element, the second connector releasably securable to the first connector so that the receiver assembly is removably securable to the band in a fixed orientation, wherein the actuator element is aligned with a longitudinal axis of the magnetostrictive member, and includes a first end in contact with the magnetostrictive member, an opposite distal second end, and a central portion extending between the first and second ends, the central portion tensionably compressed between said first and second ends when the receiver assembly is removably secured to the band in the fixed orientation.

2. The apparatus of claim 1, wherein the actuator element contacts a portion of the band so that the vibrations are conducted through the band to the tooth.

3. The apparatus of claim 1, wherein the actuator element directly contacts an outer surface of the tooth so that the vibrations are conducted directly to the tooth.

4. The apparatus of claim 3, wherein the band includes an opening, a distal end of the actuator element extending through the opening and engaging the outer surface of the tooth.

5. The apparatus of claim 1, wherein, when the receiver assembly is coupled to the band, the actuator element is disposed at an angle of between about 0° and about 90° relative to a longitudinal axis of the at least one tooth.

6. The apparatus of claim 1, wherein the band at least substantially surrounds a first tooth, and the receiver assembly transduces the audio signals into vibrations that are conducted to a second tooth.

7. The apparatus of claim 6, wherein the band is a first band, further comprising a second band at least substantially surrounding a third tooth, the third tooth adjacent to the second tooth.

8. The apparatus of claim 1, wherein the transducer further comprises:

an electrical coil responsive to variable electrical voltage and current passing therethrough for creating a varying electromagnetic field that passes through the magnetostrictive member, thereby causing the magnetostrictive member to elongate and contract in size in response to variations in the magnetic field; and a permanent magnet for effecting the electromagnetic field produced by the electrical coil.

9. The apparatus of claim 8, wherein the transducer further comprises at least one resilient element capable of compressing the magnetostrictive member, thereby generating stress within the magnetostrictive member.

10. The apparatus of claim 8, wherein the actuator element is capable of compressing the magnetostrictive member, thereby generating stress within the magnetostrictive member.

11. The apparatus of claim 1, wherein the first connector includes a receiver channel configured to receive and releasably retain the second connector therein.

12. The apparatus of claim 1, wherein the first connector is formed from a material selected from the group consisting of a biocompatible metal or a biocompatible plastic.

13. The apparatus of claim 1, wherein the first connector includes a spring lock having retention properties activated upon contact with the second connector.

14. The apparatus of claim 1, wherein the first and second connectors form a snap fitting.

15. The apparatus of claim 13, wherein the spring lock is formed from a material comprising nickel titanium.

16. The apparatus of claim 1, wherein the adhesive anatomically modifies an enamel of the tooth and utilizes the modified enamel to enhance adherence of the band to the tooth.

17. The apparatus of claim 1, wherein the adhesive comprises a cement selected from the group consisting of zinc phosphate, zinc silico-phosphate, zinc polyacrylate, zinc-polycarboxylate, glass ionomer, resin-based, and silicate-based cement.

18. The apparatus of claim 1, wherein the transducer applies a first force against one of the band or the tooth, the receiver assembly further comprising a mechanism for applying a second force to one of the band or the tooth, the second force opposing the first force so that a vector sum of the first and second forces is substantially equal to zero.

19. A method for imparting low amplitude vibrations to at least one tooth in a human head having a cochlea to facilitate hearing via a dental bone conduction pathway, comprising the steps of:

a) securing an extraoral transmitter unit to a user, the transmitter unit configured to detect ambient sounds, and to generate and wirelessly transmit audio signals corresponding to the detected ambient sounds;

b) providing a receiver assembly including a transducer having an actuator element, the receiver assembly configured to receive the audio signals from the transmitter unit, and to transduce the audio signals into vibrations, the transducer comprising a magnetostrictive member responsive to a varying magnetic field passing therethrough which elongates and contracts in response to variations in the magnetic field, and the actuator element in contact with the magnetostrictive member which vibrates as the magnetostrictive member elongates and contracts, the receiver assembly including at least a first connector spaced from the actuator element; and c) adhesively securing a band around at least one tooth in a mouth of the user, the band including at least a second connector; and d) releasably securing the first connector of the receiver assembly to the second connector of the band so that the receiver assembly is releasably secured to the band in a fixed orientation and the transduced vibrations are conducted to the cochlea via the dental bone conduction pathway, wherein the actuator element is aligned with a longitudinal axis of the magnetostrictive member, and includes a first end in contact with the magnetostrictive member, an opposite distal second end, and a central portion extending between the first and second ends, the central portion tensionably compressed between said first and second ends when the receiver assembly is removably secured to the band in the fixed orientation.

20. The method of claim 19, comprising the further step of anatomically modifying the at least one tooth prior to said step of adhesively securing the band.

21. The method of claim 19, comprising the further step of:

maintaining the actuator element against an outer surface of the at least one tooth during said step of releasably securing the receiver assembly.

22. The method of claim 19, comprising the further steps of:

forming a dental impression of the at least one tooth, secured band, and other anatomical structures in the mouth surrounding the at least one tooth;

fabricating a dental cast based on the formed dental impression; and fabricating the receiver assembly on the dental cast prior to said step of releasably securing the receiver assembly to the band.

23. The apparatus of claim 1, wherein the actuator element has a distal end axially aligned with a longitudinal axis of the magnetostrictive member.

24. The apparatus of claim 1, wherein the actuator element is substantially linear when the receiver assembly is disengaged from the band.

* * * * *